US005893546A

United States Patent [19]

Renfroe

[11] Patent Number: 5,893,546

[45] Date of Patent: Apr. 13, 1999

[54] ADJUSTABLE BOOK HOLDER

[76] Inventor: Curtis Renfroe, 925 Northwood #8204, Baytown, Tex. 77521

[21] Appl. No.: 08/832,228

[22] Filed: Apr. 3, 1997

[51] Int. Cl.[6] ..... A47B 97/04

[52] U.S. Cl. ..... 248/451; 248/461; 248/452; 248/453

[58] Field of Search ..... 248/441.1, 447, 248/451, 452, 453, 454, 457, 460, 461

[56] References Cited

U.S. PATENT DOCUMENTS

| | | | |
|---|---|---|---|
| 3,076,285 | 2/1963 | Sparkman | 248/451 X |
| 3,813,075 | 5/1974 | Capper | 248/461 |
| 3,952,989 | 4/1976 | Bannister Hatcher | 248/453 |
| 3,991,967 | 11/1976 | Sack | 248/453 X |
| 4,116,413 | 9/1978 | Andersen | 248/451 |
| 4,323,214 | 4/1982 | DeLuca | 248/452 |
| 4,978,096 | 12/1990 | Struckmann | 248/451 |
| 5,052,650 | 10/1991 | Beile et al. | 248/451 |
| 5,054,736 | 10/1991 | Champoux | 248/451 X |
| 5,290,003 | 3/1994 | Reyes | 248/461 |
| 5,451,025 | 9/1995 | Hames | 248/452 X |
| 5,580,024 | 12/1996 | Briee | 248/451 X |
| 5,651,525 | 7/1997 | Yang | 248/453 X |

*Primary Examiner*—Ramon O. Ramirez
*Assistant Examiner*—Long Dinh Phan
*Attorney, Agent, or Firm*—Joseph N. Breaux

[57] ABSTRACT

An adjustable book holder that includes a stand support member; an angularly adjustable book support assembly pivotally mounted to the stand support member; an X-Y positionable, transparent copy arm slidably mounted on a vertically oriented track member that itself is slidable along a horizontal positioning rod; a locking mechanism between the transparent copy arm and the vertically oriented track member; a page holding mechanism including a pivot block in connection with the book support assembly and a page holder including first and second lengths of wire, each length of wire being pivotally connected to the pivot block and having a ball secured at a far end thereof; and a angular positioning assembly including an angular positioning rod affixed to a back surface of the book support assembly and a stand off member slidably mounted on the angular positioning rod and extending away from the angular positioning rod at a right angle.

17 Claims, 2 Drawing Sheets

ADJUSTABLE BOOK HOLDER

TECHNICAL FIELD

The present invention relates to holding devices for holding books and the like and more particularly to an adjustable book holder including a stand support member; an angularly adjustable book support assembly pivotally mounted to the stand support member; an X-Y positionable, transparent copy arm slidably mounted on a vertically oriented track member that itself is slidable along a horizontal positioning rod; a locking mechanism between the transparent copy arm and the vertically oriented track member; a page holding mechanism including a pivot block in connection with the book support assembly and a page holder including first and second lengths of wire, each length of wire being pivotally connected to the pivot block and having a ball secured at a far end thereof; and a angular positioning assembly including an angular positioning rod affixed to a back surface of the book support assembly and a stand off member slidably mounted on the angular positioning rod and extending away from the angular positioning rod at a right angle.

BACKGROUND OF THE INVENTION

Many individuals require or enjoy using a book support for holding a book or magazine while reading. It would be a benefit to have such a book holder that was simple to construct. Because many individuals enjoy reading while reclining in bed, it would be a further benefit if the book holder had a relatively flat support surface to allow the book holder to be placed on the user's stomach if desired. In addition, because momentary distractions can cause a reader to lose his/her place, it would also be a benefit if the book holder included a line pointing element that was lockable in position to maintain the line where reading is to resume. When such a line pointing element is provided, it would be an additional benefit if the line pointing element was transparent to allow a user to read text positioned beneath the line pointing element. Because it is more comfortable to read with the book, magazine or the like at an angle, it would be a further benefit to have a book holder that included a book support surface that could be a adjusted by the user to a desired angle. Also because it is easier to read pages that are held in a flat position, it would be a still further benefit to have a page holding mechanism that could maintain the pages of a book or magazine in a flat easily readable position.

SUMMARY OF THE INVENTION

It is thus an object of the invention to provide an adjustable book holder that is simple to construct.

It is a further object of the invention to provide an adjustable book holder that has a flat support surface to allow the book holder to be placed on the user's stomach if desired.

It is a still further object of the invention to provide an adjustable book holder that has a line pointing element that is lockable in position.

It is a still further object of the invention to provide an adjustable book holder that includes a line pointing element that is transparent.

It is a still further object of the invention to provide an adjustable book holder that includes a book support surface that is adjustable by the user to a desired angle.

It is a still further object of the invention to provide an adjustable book holder that includes a page holding mechanism for maintaining the pages of a book or magazine in a flat easily readable position.

It is a still further object of the invention to provide an adjustable book holder that includes a stand support member; an angularly adjustable book support assembly pivotally mounted to the stand support member; an X-Y positionable, transparent copy arm slidably mounted on a vertically oriented track member that itself is slidable along a horizontal positioning rod; a locking mechanism between the transparent copy arm and the vertically oriented track member; a page holding mechanism including a pivot block in connection with the book support assembly and a page holder including first and second lengths of wire, each length of wire being pivotally connected to the pivot block and having a ball secured at a far end thereof; and a angular positioning assembly including an angular positioning rod affixed to a back surface of the book support assembly and a stand off member slidably mounted on the angular positioning rod and extending away from the angular positioning rod at a right angle.

It is a still further object of the invention to provide an adjustable book holder that accomplishes all or some of the above objects in combination.

Accordingly, an adjustable book holder is provided. The adjustable book holder includes a stand support member; an angularly adjustable book support assembly pivotally mounted to the stand support member; an X-Y positionable, transparent copy arm slidably mounted on a vertically oriented track member that itself is slidable along a horizontal positioning rod; a locking mechanism between the transparent copy arm and the vertically oriented track member; a page holding mechanism including a pivot block in connection with the book support assembly and a page holder including first and second lengths of wire, each length of wire being pivotally connected to the pivot block and having a ball secured at a far end thereof; and an angular positioning assembly including an angular positioning rod affixed to a back surface of the book support assembly and a stand off member slidably mounted on the angular positioning rod and extending away from the angular positioning rod at a right angle.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
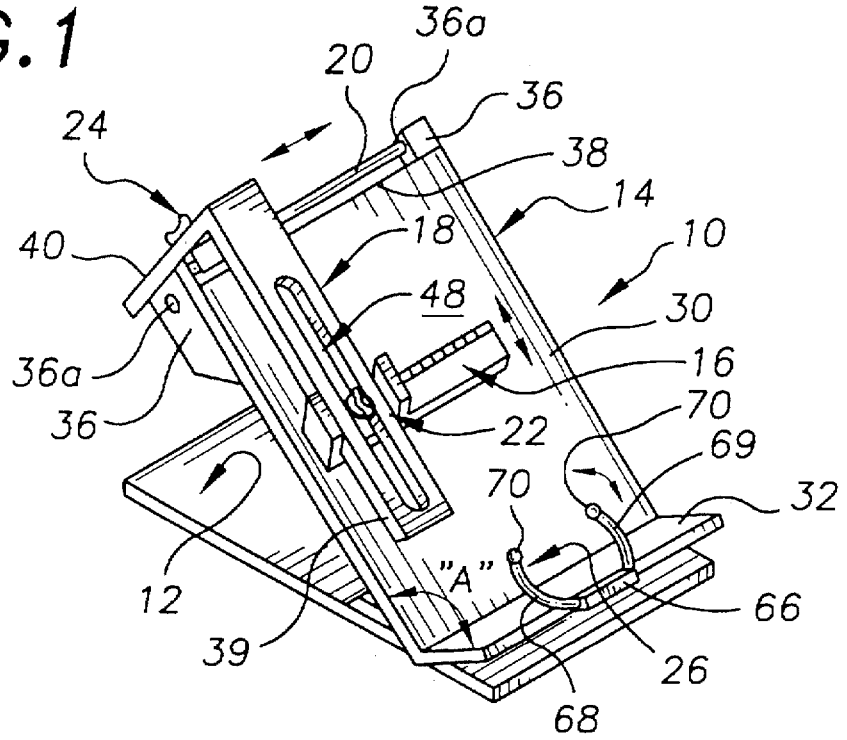
FIG. 1 is a perspective view of an exemplary embodiment of the adjustable book holder of the present invention showing the stand support member; the angularly adjustable book support assembly including the book support ledge and the book support member; the X-Y positionable, transparent copy arm; the vertically oriented track member; the horizontal positioning rod; the locking mechanism between the transparent copy arm and the vertically oriented track member; and the page holding mechanism.
Figure 4:
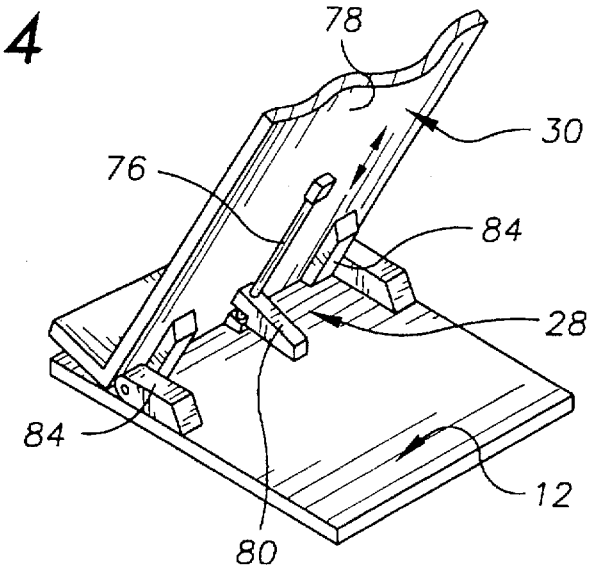
FIG. 4 is a partial rear perspective view showing a back surface of the book support member, the stand support member, that hinge connection between the book support member and the stand support member; and the angular positioning assembly including the angular positioning rod affixed to the back surface of the book support member and the elongated stand off member slidably mounted on the angular positioning rod and extending away from the angular positioning rod at a right angle.

FIG. 1 shows an exemplary embodiment of the adjustable book holder of the present invention generally designated by the numeral 10. Book holder 10 includes a stand support member, generally designated by the numeral 12; an angularly adjustable book support assembly, generally designated by the numeral 14; an X-Y positionable, transparent copy arm, generally designated by the numeral 16; a vertically oriented track member, generally designated by the numeral 18; a horizontal positioning rod 20; a first locking mechanism, generally designated by the numeral 22; a second locking mechanism, generally designated by the numeral 24; a page holding mechanism, generally designated by the numeral 26; and an angular positioning assembly, generally designated 28 (FIG. 4).

In this embodiment, stand support member 12 and book support assembly 14 are constructed from glass filled ABS plastic. Stand support member 12 is substantially rectangular in shape. Book support assembly 14 includes a rectangular shaped book support member 30 and a rectangular shaped book support ledge 32. In this embodiment, book support ledge 32 is integrally formed with book support member 30 and extends away from book support member 30 at an angle "A" of one-hundred degrees. A pair of plastic horizontal rod braces 36 are secured to book support member 30 and extend past a top edge surface 38 thereof. The ends of horizontal positioning rod 20 are positioned into and held within identical cavities 36a formed within each horizontal rod brace 36. In this embodiment, horizontal positioning rod 20 is a length of stainless steel shafting.

Figure 2:
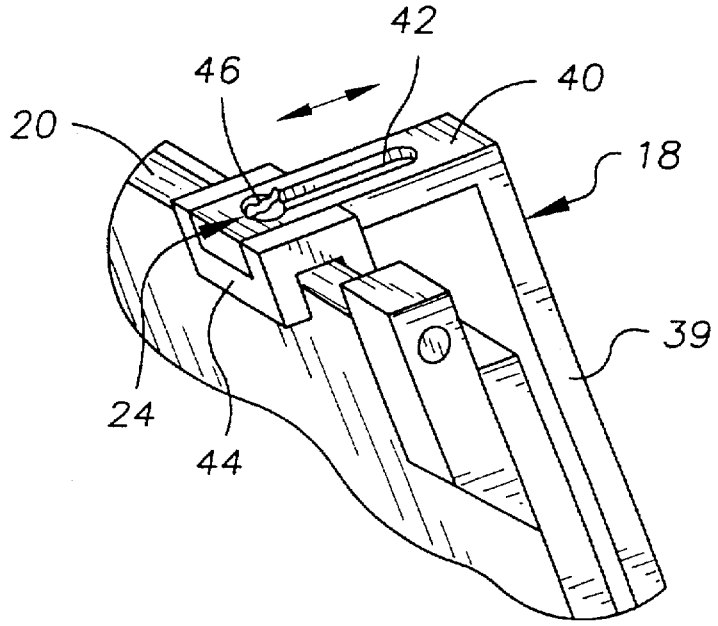
FIG. 2 is a detail perspective view showing the adjustable book holder including a depth adjustment mechanism of the vertically oriented track member, the slide block and the horizontal positioning rod.

With reference to FIG. 2, vertically oriented track member 18 includes a vertical portion 39 and a right angled portion 40 having an elongated depth adjustment trackway 42 provided therethrough. Right angled portion 40 is secured to a slide block 44 with a wing nut assembly 46 forming second locking mechanism 24. Slide block 44 is slidably mounted on horizontal positioning rod 20. Referring back to FIG. 1, in use the user can adjust the distance between vertical portion 39 and book support member 30 by loosening second locking mechanism 24, sliding right angled portion 40 along depth adjustment trackway 42 (FIG. 2) until the desired distance is achieved, and then tightening second locking mechanism 24.

Figure 3:
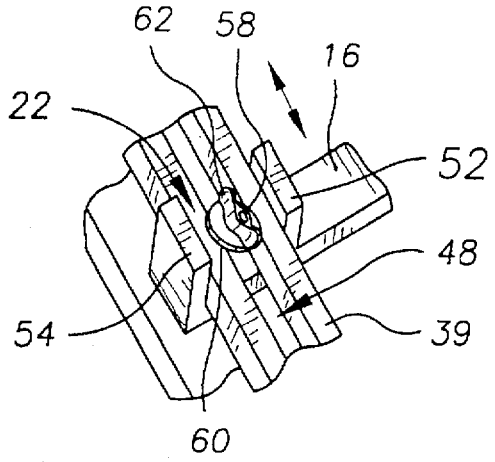
FIG. 3 is a detail perspective view of the locking mechanism between the transparent copy arm and the vertically oriented track member showing the wing nut, the friction washer, and the bolt channel of the vertically oriented track member, and the guide members of the transparent copy arm.

Vertical portion 39 of vertically oriented track member 18 has a vertical height adjustment trackway 48 provided therethrough along the length thereof. With reference now to FIG. 3, transparent copy arm 16 has a pair of upstanding guide members 52,54 that are spaced apart a distance sufficient to just receive therebetween the width of vertical portion 39. Vertical portion 39 is positioned between upstanding guide members 52,54 and slidably affixed to transparent copy arm 16 with first-locking mechanism 22. In this embodiment first locking mechanism 22 includes a bolt 58, a washer 60 and a wing nut 62.

With reference once again to FIG. 1, page holding mechanism 26 includes a pivot block 66 integrally formed with and extending from book support ledge 32 and a pair of pivoting, curved metal page holders 68,69 each having a plastic ball 70 secured to the far end thereof. In this embodiment, page holders 68,69 are formed from a single length of chrome plated steel shafting that has been inserted through a hole formed through pivot block 66 and bent at the ends thereof to form curved page holders 68,69. In use a book, magazine or like item is placed onto book support member 30 with the bottom thereof supported on book support ledge 32. The distance between vertical portion 39 and book support member 30 is then adjusted by loosening second locking mechanism 24, sliding right angled portion 40 along depth adjustment trackway 42 (FIG. 2) until the desired distance is achieved, and then tightening second locking mechanism 24. Transparent copy arm 16 is then positioned onto the book surface. The position of transparent copy arm 16 is then adjusted up and down on the book page as previously described.

Figure 5:
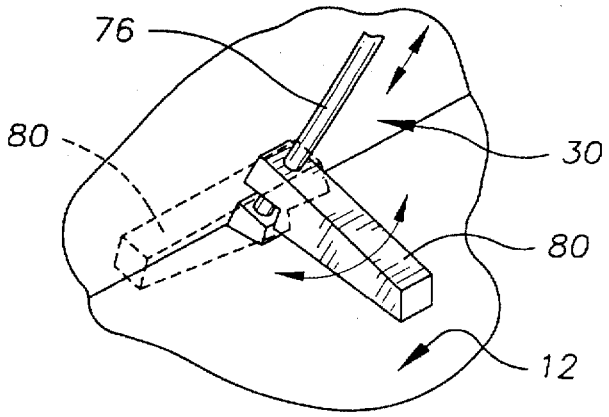
FIG. 5 is a detail perspective view showing the elongated stand off member slidably mounted on the angular positioning rod and extending away from the angular positioning rod at a right angle and pivotal about the angular positioning rod.

With reference to FIG. 4, if desired the angle of book support member 30 can be adjusted to a desirable angle by using the angular positioning assembly 28. In this embodiment angular positioning assembly 28 includes an angular positioning rod 76 affixed to a back surface 78 of book support member 30 and an elongated, resilient stand off member 80 slidably mounted on angular positioning rod 76. With reference to FIG. 5, stand off member 80 is rotatable about angular position rod 76 one-hundred-eighty degrees (180°) to allow book support member 30 to pivot on hinges 84 (FIG. 4) into a substantially parallel orientation with stand member 12 for storage. Referring back to FIG. 4, it can be seen that by positioning stand off member 80 at a desired position along angular positioning rod 76 book support member 30 can be positioned at a desired angle with respect to stand member 12.

It can be seen from the preceding description that an adjustable book holder has been provided that is simple to construct; that has a flat support surface to allow the book holder to be placed on the user's stomach if desired; that has a line pointing element that is lockable in position; that includes a line pointing element that is transparent; that includes a book support surface that is adjustable by the user to a desired angle; that includes a page holding mechanism for maintaining the pages of a book or magazine in a flat easily readable position; and that includes a stand support member; an angularly adjustable book support assembly pivotally mounted to the stand support member; an X-Y positionable, transparent copy arm slidably mounted on a vertically oriented track member that itself is slidable along a horizontal positioning rod; a locking mechanism between the transparent copy arm and the vertically oriented track member; a page holding mechanism including a pivot block in connection with the book support assembly and a page holder including first and second lengths of wire, each length of wire being pivotally connected to the pivot block and having a ball secured at a far end thereof; and a angular positioning assembly including an angular positioning rod affixed to a back surface of the book support assembly and a stand off member slidably mounted on the angular positioning rod and extending away from the angular positioning rod at a right angle.

It is noted that the embodiment of the adjustable book holder described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An adjustable book holder comprising:

a stand support member;

an angularly adjustable book support assembly pivotally mounted to said stand support member;

an X-Y positionable, transparent copy arm slidably mounted on a vertically oriented track member that itself is slidable along a horizontal positioning rod attached to said book support assembly;

a locking mechanism in connection between said transparent copy arm and said vertically oriented track member;

a page holding mechanism including a pivot block in connection with said book support assembly and a page holder including first and second lengths of wire, each length of wire being pivotally connected to said pivot block and having a ball secured at a far end thereof; and an angular positioning assembly including an angular positioning rod affixed to a back surface of said book support assembly and a stand off member slidably mounted on said angular positioning rod and extending away from said angular positioning rod at a right angle.

2. The adjustable book holder of claim 1, wherein:

said stand off member is rotatable about said angular positioning rod one-hundred-eighty degrees.

3. The adjustable book holder of claim 1, wherein:

said stand support member and said book support assembly are constructed from plastic;

said stand support member is substantially rectangular in shape; and said book support assembly includes a rectangular shaped book support member and a rectangular shaped book support ledge.

4. The adjustable book holder of claim 3 wherein:

said book support ledge is integrally formed with said book support member and extends away from said book support member at an angle "A" of one-hundred degrees.

5. The adjustable book holder of claim 1 wherein:

a pair of plastic horizontal rod braces are secured to said book support member and extend past a top edge surface of said book support member; and said horizontal positioning rod is positioned between said pair of horizontal rod braces.

6. The adjustable book holder of claim 1 wherein:

said vertically oriented track member includes a vertical portion and a right angled portion, said right angled portion having an elongated depth adjustment trackway provided therethrough, said right angled portion being secured to a slide block with a wing nut assembly forming a second locking mechanism, said slide block being slidably mounted on said horizontal positioning rod.

7. The adjustable book holder of claim 2, wherein:

said stand support member and said book support assembly are constructed from plastic;

said stand support member is substantially rectangular in shape; and said book support assembly includes a rectangular shaped book support member and a rectangular shaped book support ledge.

8. The adjustable book holder of claim 7 wherein:

said book support ledge is integrally formed with said book support member and extends away from said book support member at an angle "A" of one-hundred degrees.

9. The adjustable book holder of claim 2 wherein:

a pair of plastic horizontal rod braces are secured to said book support member and extend past a top edge surface of said book support member; and said horizontal positioning rod is positioned between said pair of horizontal rod braces.

10. The adjustable book holder of claim 2 wherein:

said vertically oriented track member includes a vertical portion and a right angled portion, said right angled portion having an elongated depth adjustment trackway provided therethrough, said right angled portion being secured to a slide block with a wing nut assembly forming a second locking mechanism, said slide block being slidably mounted on said horizontal positioning rod.

11. The adjustable book holder of claim 7 wherein:

a pair of plastic horizontal rod braces are secured to said book support member and extend past a top edge surface of said book support member; and said horizontal positioning rod is positioned between said pair of horizontal rod braces.

12. The adjustable book holder of claim 7 wherein:

said vertically oriented track member includes a vertical portion and a right angled portion, said right angled portion having an elongated depth adjustment trackway provided therethrough, said right angled portion being secured to a slide block with a wing nut assembly forming a second locking mechanism, said slide block being slidably mounted on said horizontal positioning rod.

13. The adjustable book holder of claim 9 wherein:

said vertically oriented track member includes a vertical portion and a right angled portion, said right angled portion having an elongated depth adjustment trackway provided therethrough, said right angled portion being secured to a slide block with a wing nut assembly forming a second locking mechanism, said slide block being slidably mounted on said horizontal positioning rod.

14. The adjustable book holder of claim 3 wherein:

a pair of plastic horizontal rod braces are secured to said book support member and extend past a top edge surface of said book support member; and said horizontal positioning rod is positioned between said pair of horizontal rod braces.

15. The adjustable book holder of claim 3 wherein:

said vertically oriented track member includes a vertical portion and a right angled portion, said right angled portion having an elongated depth adjustment trackway provided therethrough, said right angled portion being secured to a slide block with a wing nut assembly forming a second locking mechanism, said slide block being slidably mounted on said horizontal positioning rod.

16. The adjustable book holder of claim 14 wherein:

said vertically oriented track member includes a vertical portion and a right angled portion, said right angled portion having an elongated depth adjustment trackway provided therethrough, said right angled portion being secured to a slide block with a wing nut assembly forming a second locking mechanism, said slide block being slidably mounted on said horizontal positioning rod.

17. The adjustable book holder of claim 5 wherein:

said vertically oriented track member includes a vertical portion and a right angled portion, said right angled portion having an elongated depth adjustment trackway provided therethrough, said right angled portion being secured to a slide block with a wing nut assembly forming a second locking mechanism, said slide block being slidably mounted on said horizontal positioning rod.

* * * * *